United States Patent [19]

Moore

[11] Patent Number: 4,928,330

[45] Date of Patent: May 29, 1990

[54] HANDICAP BATHTUB LIFT

[76] Inventor: Arnold L. Moore, 1505 N. Locust St., P.O. Box 200, Canby, Oreg. 97013

[21] Appl. No.: 245,218

[22] Filed: Sep. 16, 1988

[51] Int. Cl.[5] ..... A47K 13/00

[52] U.S. Cl. ..... 4/562; 414/921

[58] Field of Search ..... 4/560, 561, 562, 563, 4/564, 565, 566, 496, 559; 414/921, 540, 541; 5/81 R, 81 B

[56] References Cited

U.S. PATENT DOCUMENTS

| | | | |
|---|---|---|---|
| 2,792,951 | 5/1957 | White | 414/541 |
| 3,371,357 | 3/1968 | Berthelsen et al. | 4/564 |
| 3,413,662 | 12/1968 | Stayton | 4/562 |
| 3,815,163 | 6/1974 | Sullivan | 4/562 |
| 3,829,916 | 8/1974 | James | 4/564 |
| 3,994,030 | 11/1976 | Cassell et al. | 4/563 |
| 4,091,478 | 5/1978 | Hardwick et al. | 4/562 |
| 4,206,523 | 6/1980 | James | 4/562 |
| 4,221,008 | 9/1980 | Nolan | 4/496 |
| 4,306,634 | 12/1981 | Sangster | 414/921 |
| 4,628,550 | 12/1986 | Walton | 4/560 |
| 4,633,538 | 1/1987 | James | 414/921 |

FOREIGN PATENT DOCUMENTS

| | | | |
|---|---|---|---|
| 2179625 | 3/1987 | United Kingdom | 5/81 R |

*Primary Examiner*—Henry J. Recla
*Assistant Examiner*—Edward Donovan
*Attorney, Agent, or Firm*—Henderson & Sturm

[57] ABSTRACT

An improved handicap bathtub lift to be installed independent of the tub for bathing by a handicapped person solely or with minimal help from another person. The lift apparatus is adaptable for installation at any point near the tub, but is generally installed towards the rear, outside of the bathtub unit. The lift is comprised of an adjustable upright post secured at the floor and ceiling with anchor bolts. Contained within the post is a threaded carriage block with threaded screw for the lift, and a frame and guide for the carriage block. A radially outwardly extending arm is pivotally secured to the adjustable upright post and supports a chair member. The arm can swing 180° from the loading area to the tub. The chair member can swivel a complete 360°, and can also be raised and lowered as needed which increases the personal safety of the user. Upon completion of the bathing operation, the unit can be pivoted in the opposite direction towards the exterior of the tub.

3 Claims, 6 Drawing Sheets

HANDICAP BATHTUB LIFT

TECHNICAL FIELD

This invention relates to lifts and more particularly to an improved lift for safely and conveniently moving handicapped persons in and out of a bathtub.

BACKGROUND ART

In the prior art, there has been inadequate provision made for keeping the chair portion of a lift in a particular position while being utilized. There are also many inherent dangers in using a bathtub lift. The prior art devices are also somewhat cumbersome to use and expensive to construct.

Those concerned with these and other problems recognize the need for an improved handicapped bathtub lift.

DISCLOSURE OF THE INVENTION

The present invention provides an improved handicap bathtub lift to be installed independent of the tub for bathing by a handicapped person solely or with minimal help from another person. The lift apparatus is adaptable for installation at any point near the tub, but is generally installed towards the rear, outside of the bathtub unit. The lift is comprised of an adjustable upright post secured at the floor and ceiling with anchor bolts. Contained within the post is a threaded carriage block with threaded screw for the lift, and a frame and guide for the carriage block. A radially outwardly extending arm is pivotally secured to the adjustable upright post and supports a chair member. The arm can swing 180° from the loading area to the tub. The chair member can swivel a complete 360°, and can also be raised and lowered as needed which increases the personal safety of the user. Upon completion of the bathing operation, the unit can be pivoted in the opposite direction towards the exterior of the tub.

The instant invention is for an improved bathtub lift, and has the distinct advantage of being installed independent of the tub and can be easily moved clear of the tub when not being used. Both the swinging arm and the carriage holding the chair can be locked into various positions, which are important safety features of the lift.

An object of the present invention is the provision of an improved handicap bathtub lift.

Another object is to provide a safe and efficient bathtub lift.

A further object of the invention is the provision of installation independent of the tub so that the lift can be moved clear of the tub when not being utilized.

Still another object is to provide operation either solely by the user or by another person.

A still further object of the present invention is the provision of control of the arm and chair portions of the lift in various positions when being utilized.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 2:
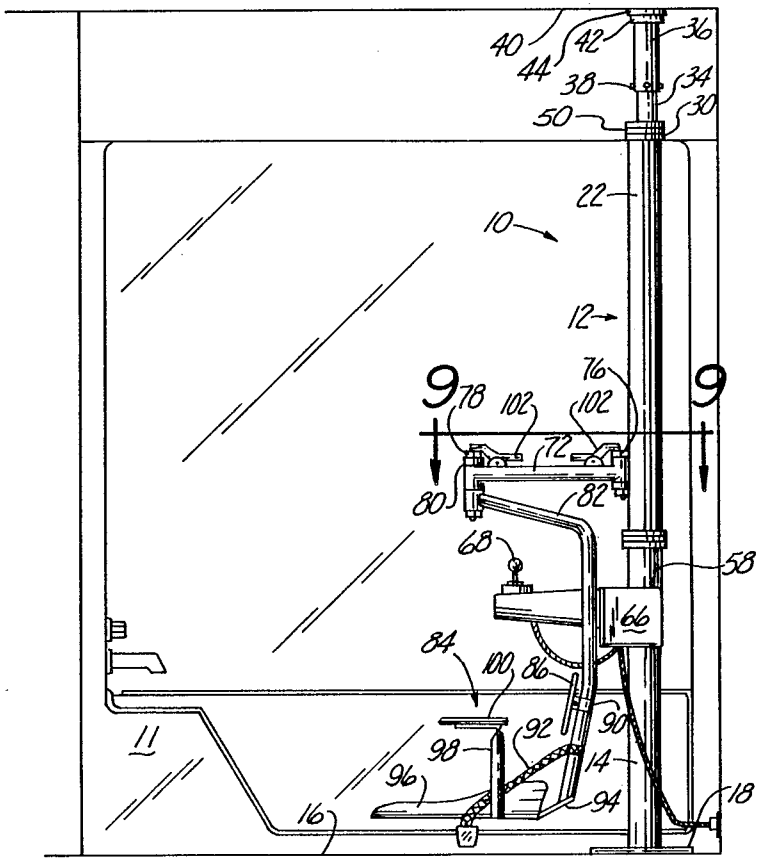
FIG. 2 is a side elevational view of the present invention showing the chair member in a lowered position.
Figure 1:
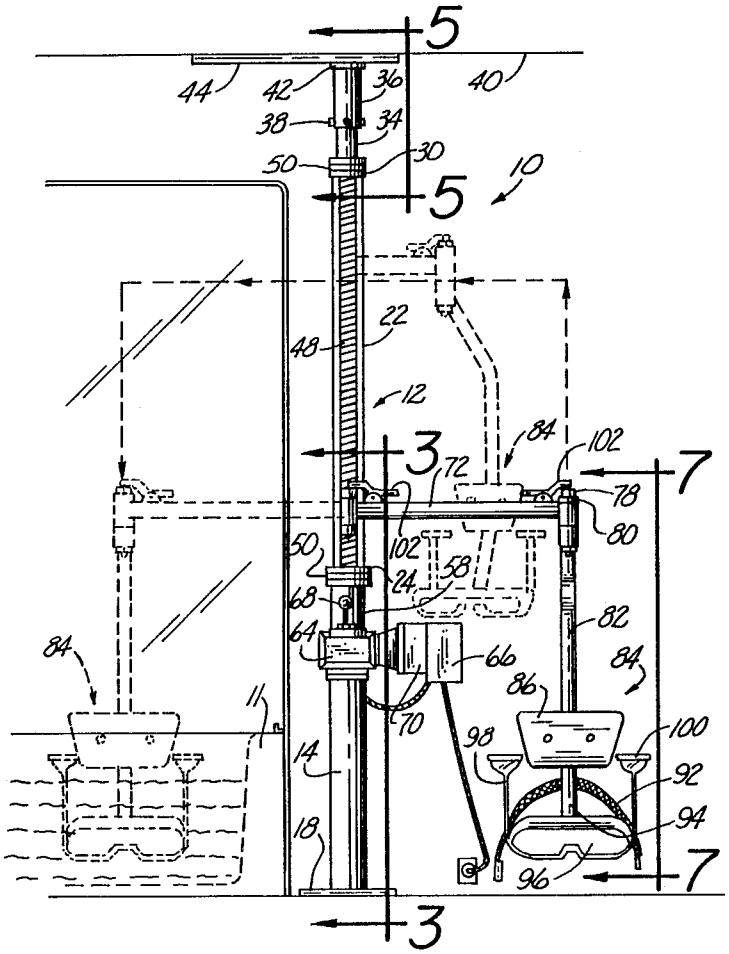
FIG. 1 is a front elevational view of a bathtub having a lift embodying the invention, parts thereof being shown in dashed lines to better illustrate the manner of use of the invention.

Referring now to the drawings, wherein like reference numerals designate identical or corresponding parts throughout the several views, FIG. 1 shows the handicap bathtub lift (10) made in accordance with the present invention and installed independent of the bathtub (11). As seen in FIG. 1 and in conjunction with some of the remaining figures, an adjustable upright post (12) with a lower base member (14) is vertically attached to the floor (16) by means of a base plate (18) and anchor bolts (20). A slotted frame and guide housing (22) is attached to the upper end of the base member (14) by means of securing flanges (24) and bolts (26). An uppermost section (34) is attached at the lower end thereof to the top section of the slotted frame and guide housing (22) by means of securing flanges (30) and bolts (32). The uppermost section (34) telescopes to adjust for various heights and is attached to the upper end of the housing (22). To adjust for heights under 12 feet, section (34) can be trimmed to the appropriate length. A collar flanged ceiling anchor (36) fits over the top portion of the uppermost section (34) and is attached thereto by set screws (38), and at the opposite end is attached to the ceiling surface (40) by means of securing flanges (42), anchoring flanges (44) and bolts (46).

Figure 3:
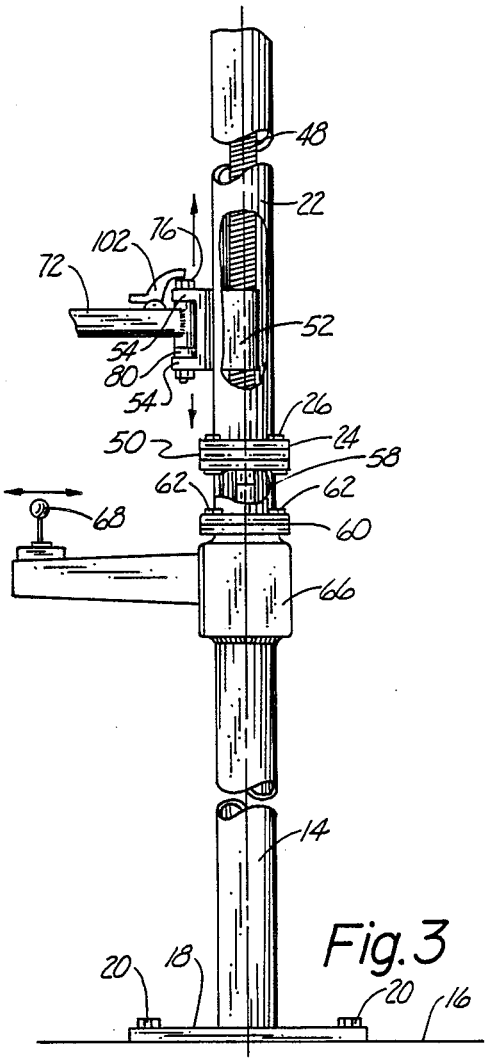
FIG. 3 is a side elevation sectional view taken along line 3—3 of FIG. 1 shown with portions broken away to show the threaded screw.
Figure 5:
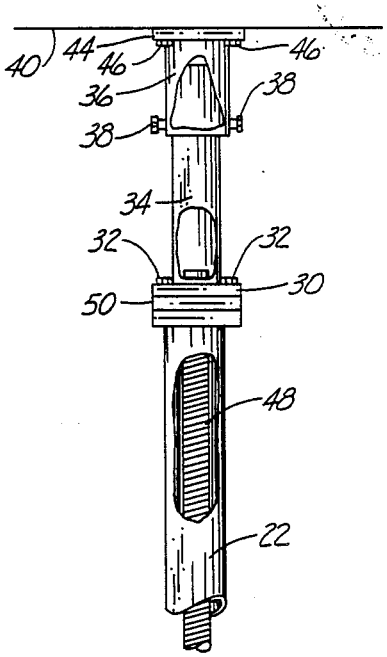
FIG. 5 is a partial side elevational view of the upper portion of the upright post member with portions broken away to show the threaded screw.
Figure 4:
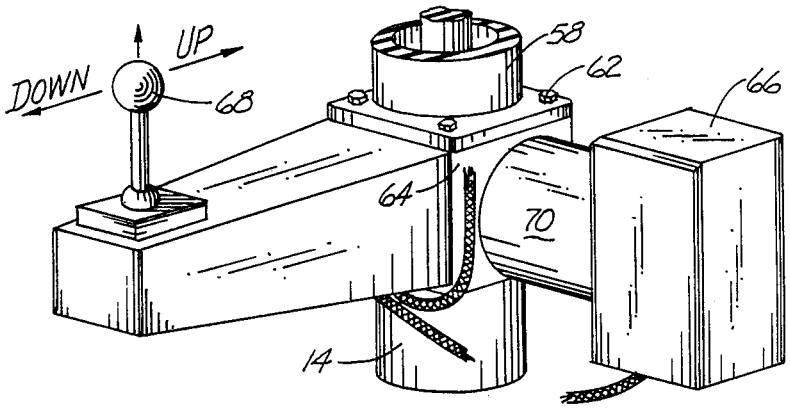
FIG. 4 is an enlarged perspective view of part of the lift including the attachment of the control arm to the gear box.
Figure 6:
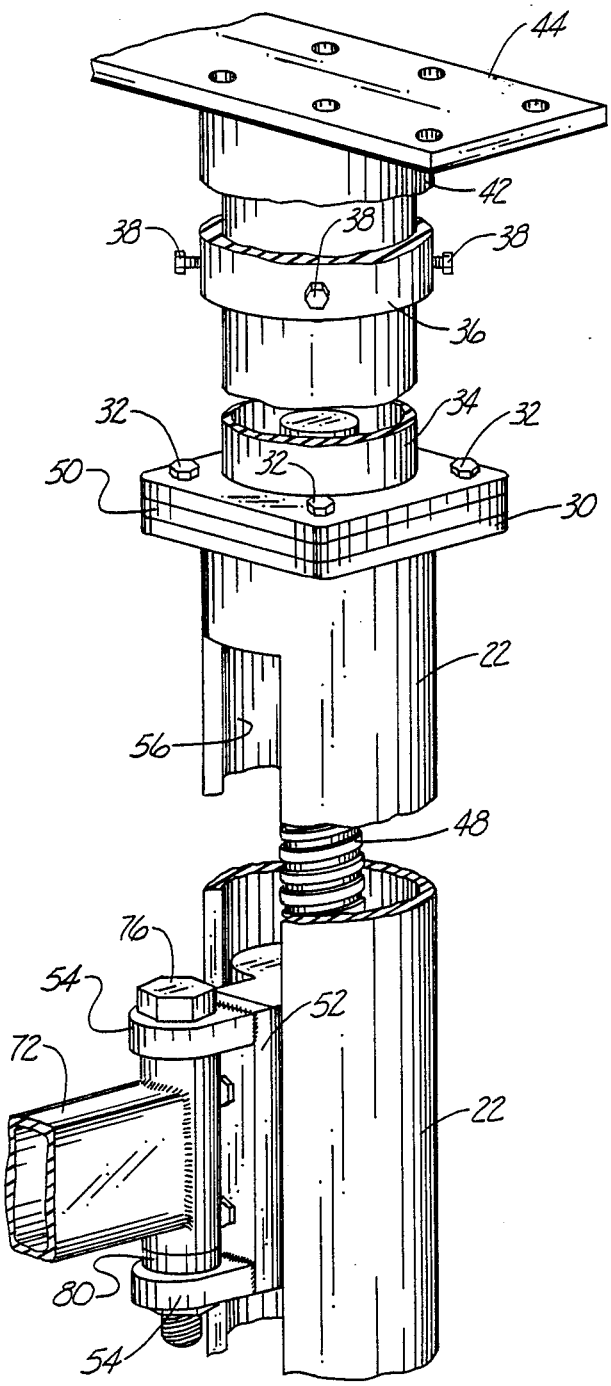
FIG. 6 is an enlarged perspective view of the upright post member with portions broken away to show the carriage block and the threaded screw.
Figure 7:
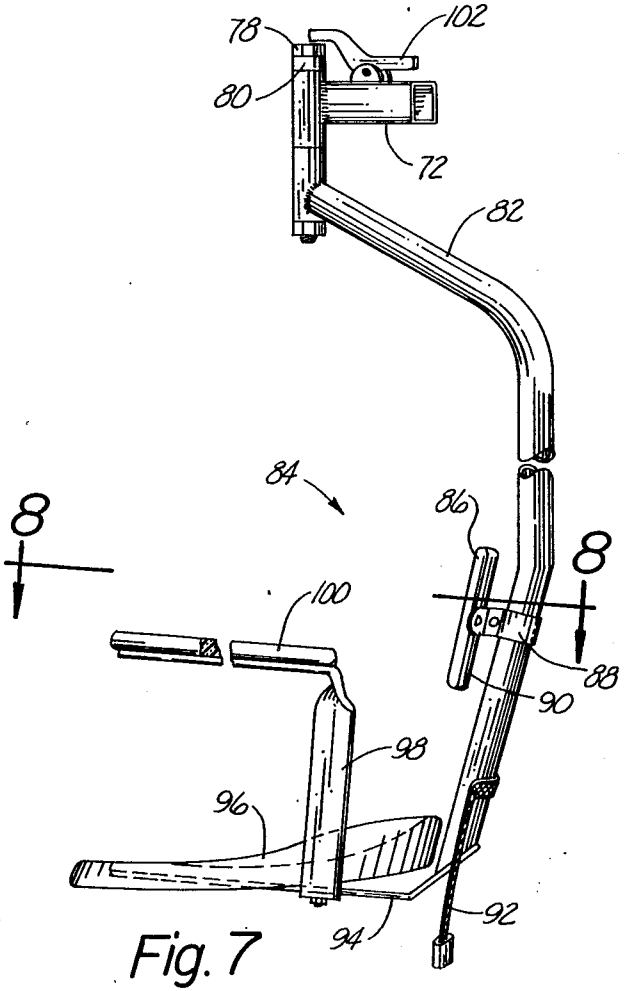
FIG. 7 is a side elevation sectional view taken along line 7—7 of FIG. 1.
Figure 8:
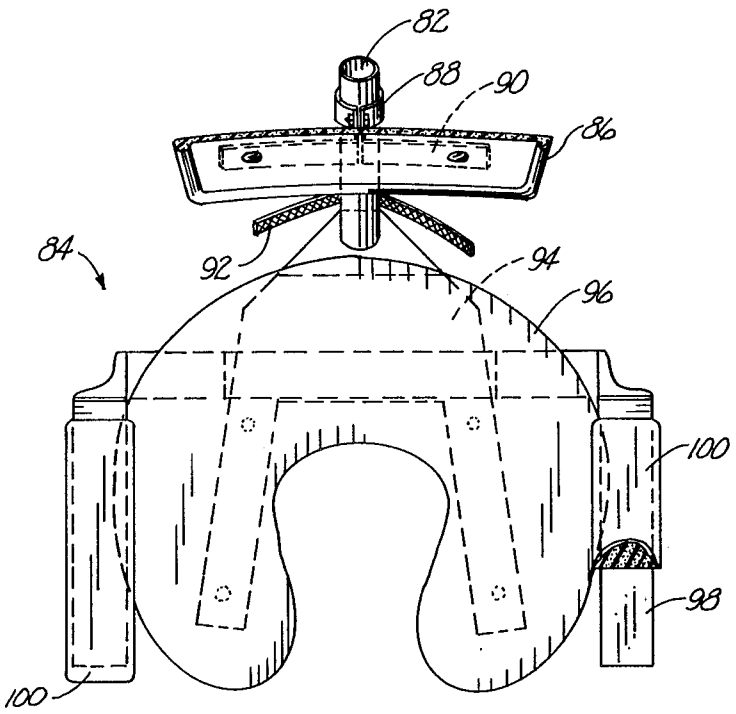
FIG. 8 is a top plan sectional view taken along line 8—8 of FIG. 7.

FIGS. 1 and 3 show a threaded screw (48) journalled within the slotted frame and guide housing (22) for rotation on bearings (50) located at each end of the housing (22).

As can be seen in FIGS. 1, 3, 6, 9 and 10, a carriage block (52) is threadably attached to the threaded screw (48) and has a yoke section (54) extending through a slot (56) in the frame and guide housing (22).

As shown in FIGS. 1–4, the base member (14) is attached to gear box (64). A make-up coupling box (58) is attached to gear box (64) and the housing (22) by means of securing flanges (60), (23) and bolts (62), (26). The gear box (64) is mechanically coupled to the threaded screw (48). A reversible electric motor (70) is drivably attached to the gear box (64). A joy stick control (68) through a central relay (66) is electrically attached to the motor (70) to control the actual operation of the lift (10).

Figure 9:
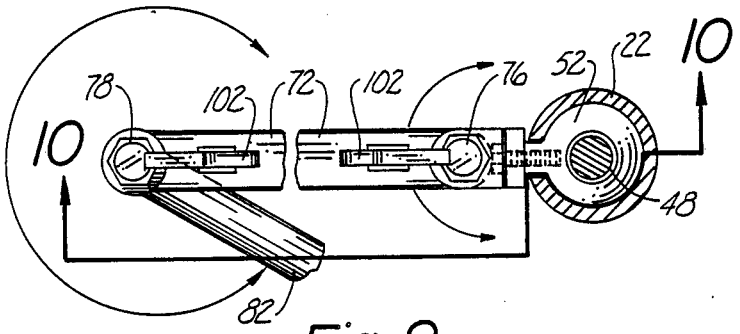
FIG. 9 is an enlarged sectional view taken along 9—9 of FIG. 2.
Figure 10:
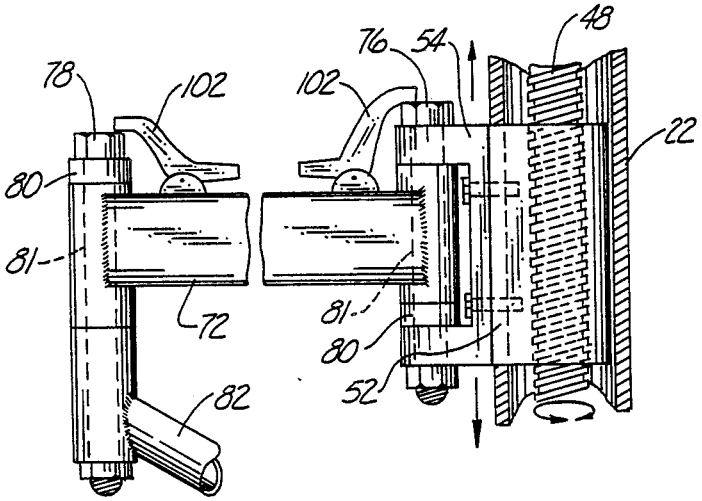
FIG. 10 is an enlarged sectional view taken along line 10—10 of FIG. 9.

As seen in FIGS. 1, and 9–10, a horizontal swinging arm (72) has one end pivotally attached to the threaded screw (48) through the carriage block (52) by swing pin (76) received in bronze bushing (81) and a thrust bearing (80) located above the bottom section of yoke (54). The swinging arm (72) is rotatable in a 180° arc. A pivot connection (78) received in bronze bushing (81) is attached to the other end of the swinging arm (72) by a thrust bearing (80) and is rotatable to 360°.

FIGS. 1, 2 and 7–9 show a C-shaped carriage rod (82) with its top attached to the pivot connection (78). Rod (82) supports a seat assembly (84) which includes a back rest (86) attached to the C-shaped carriage rod (82) by means of a clamp (88) and having a metal back support (90). A seat belt (92) is anchored at one end to the C-shaped carriage rod (82). Metal seat frame (94) is welded to the end of the C-shaped carriage rod (82) and has a fiberglass seat (96) attached thereto. Metal arm rest supports (98) are bolted to the metal seat frame (94), and fiberglass arm rests (100) are attached to supports (98). Swing stops (102) are located at both ends of the horizontal swinging arm (72) and are disposed to selectively engage the swing pin (76) and the pivot connection (78) to prevent pivotal movement with respect to the arm (72).

In operation, the reversible electric motor (70) is activated by the joy stick control (68). By operating the reversible motor (70), the threaded screw (48) is caused to rotate in either a clockwise or counterclockwise manner, the direction dependent upon whether the arm (72) is to be raised or lowered on the threaded screw (48). The swinging arm (72) has one end pivotally attached to threaded screw (48) through carriage block (52) by swing pin (76) and also moves in an upward or downward manner in conjunction with the direction of threaded screw (48). The swinging arm (72) is movable in an arc of 180° with respect to the carriage block (52) to the desired position. Once the desired position is reached, the swing stop (102) is positioned to engage swing pin (76) and the arm (72) is locked in position.

A pivot connection (78) is attached to the other end of swinging arm (72) by a thrust bearing (80), making this end of the arm rotatable in a 360° arc. A C-shaped carriage rod (82) is attached at the top to the pivot connection (78) on the arm (72). Rod (82) has a seat assembly (84) attached at its lower end. When pivoted to the desired position, the swing stop (102) located at the top portion of rod (82) is positioned to engage pivot connection (78) and the seat assembly (84) is locked in position.

A person first positions themselves into the seat assembly (84) and the seat belt (92) is fastened for security. Swing stops (102) on the swinging arm (72) are released and the arm (72) and the seat assembly (84) are moved to the desired position with respect to the arm (72). The swing stops (102) are then engaged to prevent pivotal movement. The joy stick control (68) is then moved to operate the reversible motor (70) so that the threaded screw (48) can be rotated to cause the carriage block (52) to travel upward to move the lift (10) in an upward direction until it is positioned above the side of the tub (11) (see FIG. 1). When this position is reached, the joy stick (68) is allowed to return to its neutral position. The swing stops (102) are again manipulated as needed to reposition the arm (72) and the seat assembly (84). The joy stick (68) is then moved to operate the motor (70) to rotate the threaded screw (48) in the opposite direction so that the seat assembly (84) can be lowered to a desired position in the tub (11) as shown by the dashed line representation in FIG. 1.

Upon completion of bathing by the person utilizing the lift (10), the reverse operation is used to raise the seat assembly (84), pivot the arm (72) 180° to position the seat assembly (84) above the floor (16), and lower the seat assembly (84).

Figure 12:
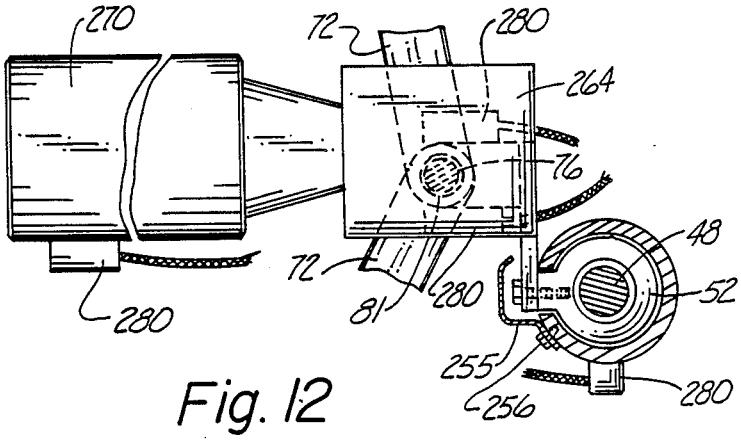
FIG. 12 is a top plan sectional view taken along line 12—12 of FIG. 11 illustrating the placement of a safety guard cover.
Figure 11:
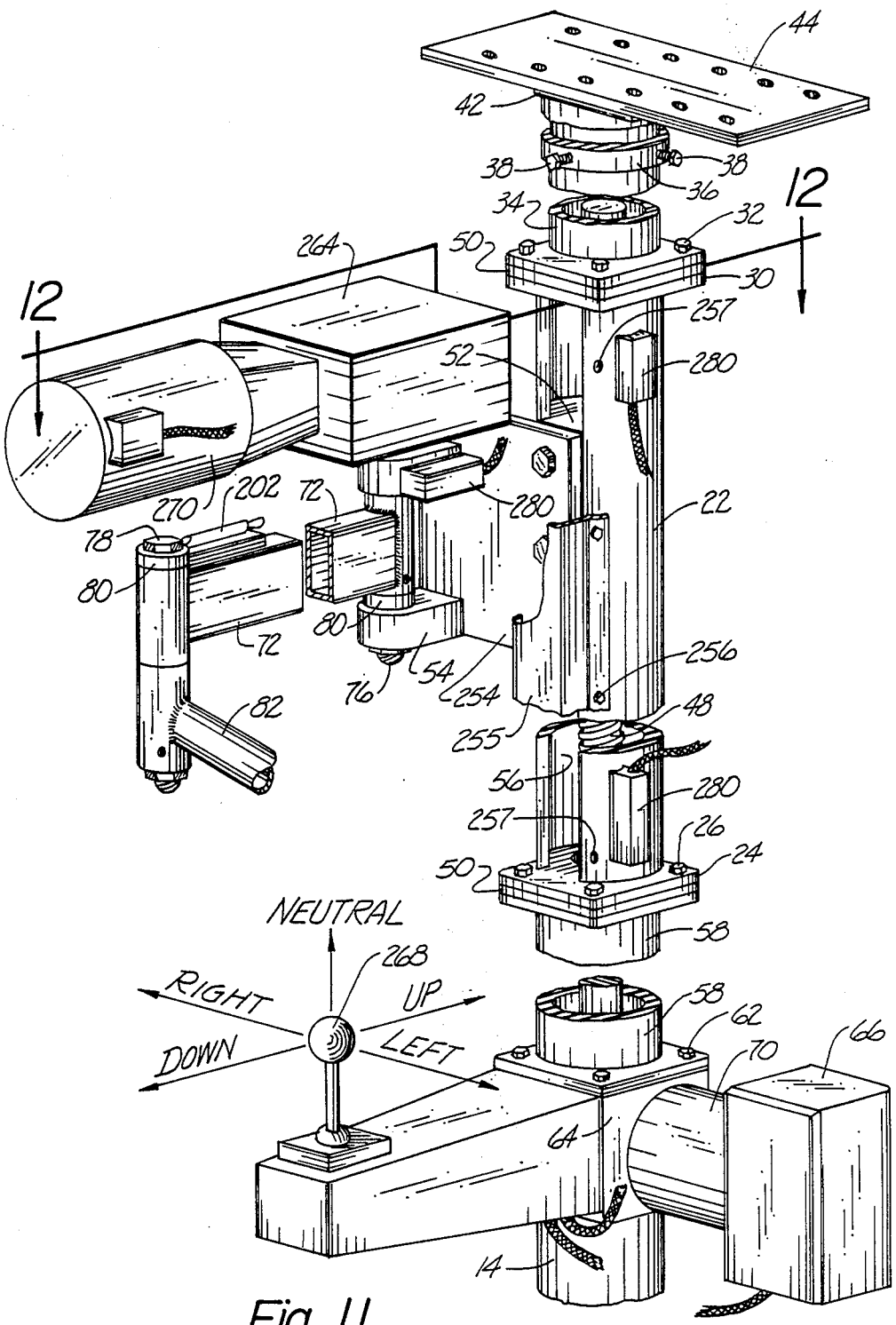
FIG. 11 is an enlarged perspective view of an alternate embodiment including a horizontal swing arm powered by a reversible motor.

The alternate embodiment shown in FIGS. 11 and 12 changes the detail of the yoke section (254) to provide for installation of a safety guard cover (255) to cover slot in frame (22), carriage block (52) and threaded screw (48). The cover (255) is attached by screws (256) received in threaded holes (257).

Gear box (264) is attached to yoke section (54) and swing pin (76), or swing pin (76) is mechanically coupled to gear box (264). A reversible electrical motor (270) is attached to gear box (264) and is drivable through a five way (left, right, up, down and center off) joy stick control (268) through central relay (66). The five way joy stick control (268) actually operates horizontal swing arm (72) to rotate 180° from right to left. Also, the five way joy stick control (268) operates the upward and downward movement of swing arm (72) through central relay (66).

Electrical limit switches (280) are placed on each side and at the top of yoke (54) to control and contain pivot of swinging horizontal swing arm (72). The electrical limit switches (280) are placed at the top and bottom of the guide housing (22) to control upward and downward movement of carriage block (52).

At each end of swing arm (72), the pins (76), (78) have oil impregnated bronze cylindrical bearings (81) and anti-friction thrust bearings (80). The rotation of pin (78) is selectively controlled by spring bolt latch (202).

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. A handicap bathtub lift comprising:

an adjustable vertical post being attached to both floor and ceiling surfaces and including a base member with the lower portion thereof attached to the floor surface by a base plate and anchor bolts, a slotted frame and guide housing attached to the upper end of the base member by means of securing flanges and bolts, an uppermost section attached at the lower end thereof to the top section of the slotted frame and guide housing by means of securing flanges and bolts, said uppermost section being telescoped to adjust for various heights, a collar flanged ceiling anchor which fits over the top portion of the uppermost section and is attached thereto by means of set screws, and at the opposite end attached to the ceiling surface by means of securing and anchoring flanges and bolts;

a threaded screw journalled within the slotted frame and guide housing for rotation on bearings located at each end of the housing;

a carriage block threadably attached to the threaded screw and having a yoke section extending through a slot in the frame and guide housing;

means for selectively rotating the threaded screw;

a horizontal swinging arm with one end pivotally attached to the threaded screw through the carriage block by a swing pin and being rotatable in a 180° arc with respect to said post;

a pivot connection attached to the other end of the swinging arm by a thrust bearing and being rotatable in a 360° arc about a vertical axis;

a C-shaped carriage rod with a top section attached to the pivot connection, said carriage rod being disposed to support a seat assembly including a back rest attached to the C-shaped carriage rod by means of a clamp, a seat belt anchored at one end to the C-shaped carriage rod below the back rest clamp, a metal seat frame welded to the end of the C-shaped carriage rod and having a fiberglass seat attached thereto, and metal arm rest support bolted to the metal seat frame and having fiberglass arm rests attached thereto; and swing stops attached to the horizontal swinging arm and being disposed to selectively engage said swing pin and said pivot connection to selectively prevent the pivotal movement with respect to said horizontal swinging arm.

2. The lift of claim 1 wherein said means for rotating the threaded screw includes a reversible electrical motor drivably coupled to the threaded screw.

3. The lift of claim 2 further including a joy stick control electrically attached to the motor to control the operation of the lift.

* * * * *